United States Patent [19]

Kinoshita

[11] Patent Number: 4,545,214

[45] Date of Patent: Oct. 8, 1985

[54] HEAT PUMP SYSTEM UTILIZABLE FOR AIR CONDITIONER, WATER SUPPLY APPARATUS AND THE LIKE

[75] Inventor: Teruo Kinoshita, Tokyo, Japan

[73] Assignee: Misawa Homes Co., Ltd., Japan

[21] Appl. No.: 683,649

[22] Filed: Dec. 19, 1984

[30] Foreign Application Priority Data

Jan. 6, 1984 [JP] Japan ..... 59-283

[51] Int. Cl.[4] ..... F25B 13/00; F25B 27/02

[52] U.S. Cl. ..... 62/160; 62/183; 62/238.6; 62/238.7

[58] Field of Search ..... 62/160, 183, 238.6, 62/238.7

[56] References Cited

U.S. PATENT DOCUMENTS

| | | | |
|---|---|---|---|
| 3,481,152 | 12/1969 | Seeley | 62/183 X |
| 4,248,059 | 2/1981 | Dearling | 62/238.7 |
| 4,253,312 | 3/1981 | Smith | 62/238.6 X |
| 4,399,664 | 8/1983 | Derosier | 62/238.7 |
| 4,474,018 | 10/1984 | Teagan | 62/183 X |

FOREIGN PATENT DOCUMENTS

| | | |
|---|---|---|
| 58-69346 | 4/1983 | Japan . |
| 58-205040 | 11/1983 | Japan . |

*Primary Examiner*—Lloyd L. King

*Attorney, Agent, or Firm*—Lowe, King, Price & Becker

[57] ABSTRACT

In a heat pump system according to the present invention, a plurality of heat exchangers are arranged in sequence in the vertical direction in a tank for storing a heat medium therein, and these heat exchangers are connected in series to a heat exchanger arranged outside the tank to construct a cooling medium circulating passage. A by-passing passage by-passing the heat exchanger arranged outside the tank and expanding means arranged in series to this heat exchanger is formed in the cooling medium circulating passage, and an expansion passage is arranged in parallel to the cooling medium circulating passage connected to the heat exchangers within the tank. The flowing direction of the cooling medium in the cooling medium circulating passage is selectively reversed and a passage for circulation of the cooling medium is selected by selecting means, so that the heat exchangers in the tank are caused to selectively function as condensers or evaporators, whereby a warm heat medium and a cooling medium are stored in the tank or layers of the warm heat medium or cold heat medium differing in the temperature are formed in the tank. A cooling and heating apparatus is operated by the heat medium in the tank, the temperature of which is thus controlled, to control the temperature in a room at an appropriate level, or a water supply apparatus is operated by the temperature-controlled heat medium in the tank to supply warm water and/or cold water maintained at an appropriate temperature to the outside.

14 Claims, 1 Drawing Figure

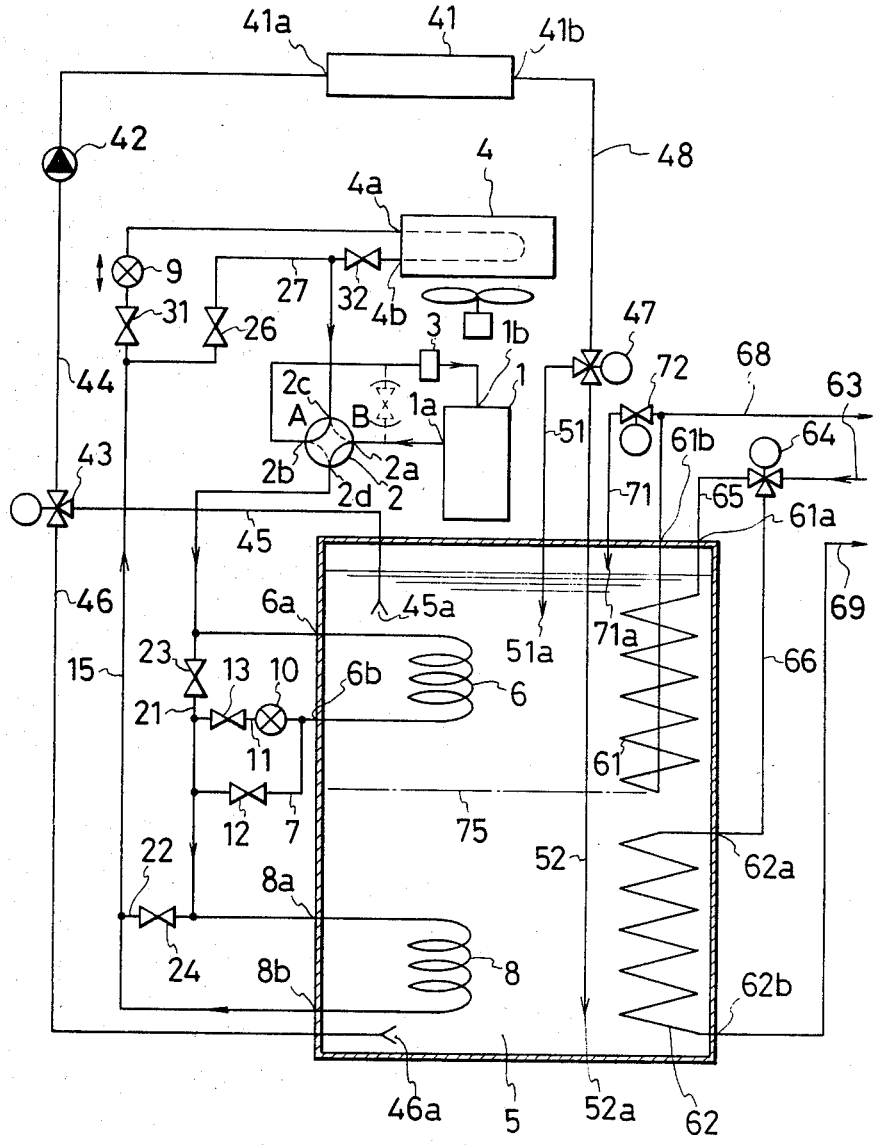
41a
41
41b
42
48
4
4a
9
27
32
4b
3
1b
31
26
47
72
68
63
44
2c
A
B
1a
1
51
61b
64
43
2b
2a
2d
2
71
65
61a
45
46
6a
45a
51a
71a
69
15
23
13
10
6b
6
66
21
11
61
12
7
75
52
62a
22
8a
24
8b
8
62b
46a
5
52a
62

HEAT PUMP SYSTEM UTILIZABLE FOR AIR CONDITIONER, WATER SUPPLY APPARATUS AND THE LIKE

BACKGROUND OF THE INVENTION

A so-called heat pump for absorbing heat from one heat source and emitting heat to the other heat source is often used for an air conditioner or a hot water supply apparatus at the present.

In the conventional heat pump system, heat exchangers are arranged for both the heat sources, respectively, and the heat exchangers are connected to each other through a cooling medium circulating passage and generally, according to the circulation direction of the cooling medium, one of the heat exchangers is used as an evaporator and the other heat exchanger is used as a condenser to function for a freezing cycle. If one heat exchanger is arranged within a tank where a heat medium such as water is stored, according to the circulation direction of the cooling medium, warm water is stored in the tank when the heat exchanger is a condenser or cold water is stored in the tank when the heat exchanger is an evaporator.

Namely, according to the conventional technique, only warm water or cold water is contained and stored in the tank but there cannot be exerted a function of simultaneously storing both the warm and cold water in the tank.

As examples of the conventional heat pump system, there can be mentioned a system disclosed in Japanese Unexamined Patent Publication No. Sho-58-69346 and a system disclosed in Japanese Unexamined Patent Publication No. Sho-58-205040. The former apparatus is a hot water supply apparatus provided with a heat pump, in which two heat exchangers for supply of hot water are connected to each other in series. The first heat exchanger for supply of hot water is used mainly for effecting heat exchange during the condensation process of the freezing cycle and warm water of a relatively low appropriate temperature is supplied. On the other hand, the second heat exchanger for supply of hot water is used mainly for effecting heat exchange in the gas zone during the condensation process, and a part of warm water heated by the first heat exchanger is further heated to supply water of an elevated temperature.

When this hot water supply apparatus is used in households for supplying warm water of a relatively low temperature to be used for bathing, washing, face washing and cleaning and for supplying hot water of a relatively high temperature to be used as additional hot water to a bath. In this system, the disadvantage of the conventional technique in which relatively low temperature warm water is supplied by using the heat pump apparatus and an auxiliary heat source such as an electric heater is necessary for supplying hot water at a relatively high temperature is eliminated. Namely, in this heat pump apparatus, two kinds of elevated temperature water differing in the temperature are produced.

The latter apparatus has a structure in which water heat-exchanged outside is introduced into a heat accumulating tank where water is stored. When cold water is introduced into this heat accumulating tank, the heat of water taken out from the upper portion of the heat accumulating tank is discharged in the exterior heat exchanger to form cold water and this cold water is introduced into the lower portion of the heat accumulating tank, and when warm water is introduced into the heat accumulating tank, the heat of water taken out from the lower portion of the heat accumulating tank is absorbed by the exterior heat exchanger to form warm water and this warm water is introduced into the upper portion of the heat accumulating tank.

Accordingly, in this apparatus, there can be attained effects of preventing mingling of cold water and warm water in the heat accumulating tank and increasing the heat exchange efficiency of the heat exchanger. However, the heat accumulating tank of this conventional type has no function of positively producing cold water and warm water.

It is apparent from the above-description that the conventional heat pump systems have only a function of producing warm water or cold water, and a heat pump system capable of simultaneously producing two kinds of elevated temperature water differing in the temperature, two kinds of cold water differing in the temperature or cold water and warm water has not been provided.

SUMMARY OF THE INVENTION

It is a primary object of the present invention to provide an excellent heat pump system in which the defects of the above-mentioned conventional apparatus are eliminated and a variety of heat medium temperatures can be produced in a tank.

Namely, according to the present invention, there is provided a heat pump system in which a heat medium in a tank has a plurality of temperatures in layers generally lowered from an upper position to a lower position in the tank and a cold heat medium and a hot medium can simultaneously be produced.

Another object of the present invention is to provide a heat pump system in which an entire heat medium in a tank is heated at a high temperature and the temperature of the high temperature heat medium is set so that the temperature is gradually lowered in layers from the upper portion to the lower portion in the tank.

Still another object of the present invention is to provide a heat pump system in which only the upper portion of a heat medium in a tank is heated at a high temperature.

A further object of the present invention is to provide a heat pump system in which a heat medium in a tank can be heated at a substantially equal level.

A still further object of the present invention is to provide a heat pump system in which an entire heat medium in a tank is cooled to a low temperature and the temperature of the low temperature heat medium can be gradually increased in layers from the lower portion of the tank.

A still further object of the present invention is to provide a heat pump system in which only the lower portion of a heat medium in a tank can be cooled to a low temperature.

A still further object of the present invention to provide an air conditioner in which cooling or heating set at an appropriate temperature can be performed by heat exchange with a heat medium in a tank, which is controlled in any one of the above-mentioned manners.

A still further object of the present invention is to provide a water supply apparatus in which cold water or warm water set at an appropriate temperature can be supplied by heat exchange with a heat medium in a tank controlled in any one of the above-mentioned manners.

In accordance with one fundamental aspect of the present invention, the above-mentioned objects and effects can be attained by a heat medium temperature controlling heat pump system which comprises a tank for storing a heat medium therein, a plurality of first heat exchange means arranged in sequence from the upper portion to the lower portion in the tank, second heat exchange means arranged outside the tank, a cooling medium circulating passage for connecting a plurality of said first heat exchange means to said second heat exchange means in series, means for forcibly circulating a cooling medium in the cooling medium circulating passage, means for reversing the flowing direction of the cooling medium in the cooling medium circulating passage, at least one cooling medium expanding means connected in parallel to the portion of the cooling medium circulating passage between two adjacent upper and lower first heat exchange means, second cooling medium expanding means arranged in series in the portion of the cooling medium circulating passage between the lowermost first heat exchange means and the second heat exchange means, a first by-passing passage by-passing the second heat exchange means and the second cooling expanding means so that the cooling medium circulating passage is short-circuited, first valve means for selectively introducing the cooling medium into one of the first cooling medium expanding means and the portion of the cooling medium circulating passage parallel to said first cooling medium expanding means, and second valve means for selectively introducing the cooling medium into one of the first by-passing passage and the second heat exchange means.

In accordance with another aspect of the present invention, the heat pump system having the above-mentioned structure is provided for means for taking out a heat medium in the tank and circulating it into heat exchange means for an air conditioner and warming or cooling air by said heat exchange means or provided for water supply means for taking out warm water and/or cold water heat-exchanged with the heat medium in the tank by said heat exchange means to the outside of the tank and applying warm water and/or cold water to intended use.

The above-mentioned objects and structural features of the present invention will become apparent from embodiments illustrated hereinafter.

BRIEF DESCRIPTION OF THE DRAWING

The accompanying drawing shows a schematic diagram illustrating an embodiment of the present invention.

DETAILED DESCRIPTION OF THE PREFERRED EMBODIMENTS

Referring to the drawings, a cooling medium extrusion port 1*a* of a cooling medium compressor 1 acting as the cooling medium forcibly circulating means is connected to one port 2*a* of a four-way valve 2, and a cooling medium sucking port 1*b* of the cooling medium compressor 1 is connected to another port 2*b* of the four-way valve 2. The four-way valve 2 acts as means for changing the flowing direction of the cooling medium.

Each of remaining two ports 2*c* and 2*d* of the four-way valve 2 is connected to an exterior heat exchange 4 (second heat exchanger) for heat-exchanging outer air with the cooling medium and is connected to a connecting port 6*a* of a heat exchanger 6 arranged in the upper portion within a tank 5 in which a heat medium is stored, respectively.

The other connecting port 6*b* of the heat exchanger is connected in series to a connecting port 8*a* of a heat exchanger 8 arranged in the lower portion within the tank 5 through a portion 7 of a cooling medium circulating passage, and the other connecting port 8*b* of the heat exchanger 8 is connected to one connecting port 4*a* of the exterior heat exchanger 4 through expanding means 9 such as a capillary tube or expanding valve means. An expanding passage 11 provided with expanding means 10 is connected in parallel to the portion 7 of the cooling medium circulating passage, and first valve means comprising opening and closing valves 12 and 13 are disposed so that the cooling medium is selectively circulated in the passage 7 or the passage 11.

Heat exchangers 6 and 8 (first heat exchangers) in the tank 5 and exterior heat exchanger 4 (second heat exchanger) act as both of condensers and an evaporator, selectively. In the drawings, two heat exchangers 6 and 8 are arranged within the tank 5, but at least three heat exchangers may be arranged within the tank 5 separately from one another in the vertical direction. The cooling medium compressor 1, heat exchangers 6 and 8, expanding means 9 and exterior heat exchanger 4 are connected in series by a cooling medium circulating passage 15 constituting a heat pump cycle.

A by-passing passage 21 short-circuiting the cooling medium circulating passage 15 is arranged to by-pass the heat exchanger 6 in the tank 5 and the expanding means 10. A by-passing passage 22 short-circuiting the cooling medium circulating passage 15 is arranged to by-pass the lowermost heat exchanger 8. Opening and closing valves are disposed in the by-passing passages 21 and 22. By opening or closing of valve means 11 and 13 comprising the valves 11 and 13, it is selected whether the cooling medium flows in the portion 7 of the cooling medium circulation passage through the heat exchanger 6 or flows in the expanding means 10, and moreover, by opening or closing of an opening and closing valve 23, it is selected whether the cooling medium circulates in the heat exchanger 6 or does not circulate through the heat exchanger 6 but by-passes it.

A by-passing passage 27 provided with a valve 26 selectively opened and closed is connected in parallel to the series cooling medium circuit of the expanding means 9 and exterior heat exchanger 4, and valve means comprising a selectively opened and closed valve 32 is interposed between the connecting part of the by-passing passage 27 and the expanding means 9 and exterior heat exchanger 4 so that when the valve 26 is opened, the vaporized cooling medium is not intruded into the exterior heat exchanger 4.

In a room, there is arranged a heat exchanger for an air conditioner such as a cooling and heating apparatus, and the heat medium is circulated between the heat exchanger 41 and the tank 5 by heat medium circulating means to control the air temperature in the room. More specifically, one port of a three-way electromagnetic valve 43 is connected to a suction port 41*a* of the heat exchanger 41 through a heat medium passage 44 having a circulating pump 42. The other two ports of the three-way electromagnetic valve 43 are connected to take-out openings 45*a* and 46*a* arranged in the tank at positions corresponding to the heights of the heat exchangers 6 and 8 through heat medium passages 45 and 46, respectively. An extrusion opening 41*b* of the heat exchanger 41 is connected to one port of a three-way electromagnetic valve 47 through a heat medium passage 48, and the other two ports of the three-way electromagnetic valve 47 are connected to the heat medium in the tank at positions corresponding to the heights of the heat exchangers 6 and 8 via extrusion openings 51*a* and 52*a* through heat medium passages 51 and 52, respectively. The three-way electromagnetic valves 43 can select the heat medium passage 45 or the heat medium passage 46 and the three-way electromagnetic valve 47 can select the heat medium passage 52 or the heat medium pasage 51, so that the heat medium in the tank is introduced into the heat exchanger 41, heat-exchanged with air in the room and returned into the tank 5.

Furthermore, the system of the present invention comprises water supply means for supplying cold water or warm water of a predetermined temperature by heat-exchanging the heat medium having the temperature controlled in the tank 5 with water.

More specifically, in the tank 5, heat exchangers 61 and 62 (third heat exchangers) are arranged separately from each other in the vertical direction at positions corresponding to the heights of the heat exchangers 6 and 8. Water of normal temperature fed from water supply passages 65 and 66 is selectively supplied to suction ports 61*a* and 62*a* of the heat exchangers 61 and 62 via water supply passages 65 and 66 through a three-way electromagnetic valve 64 and transfer heat exchange is effected between this water and the heat medium in the heat exchangers 61 and 62, whereby cold water or warm water of a predetermined temperature is prepared. So-prepared cold water or warm water is supplied to the outside through water supply pipes 68 and 69 connected to extrusion ports 61*b* and 62*b*. A reflux passage 71 having an opening and closing valve 72 is connected to the water supply pipe 68, and water is supplied into the tank 5 through a water supply opening 71*a* which is an extrusion opening of the reflux passage 71. Of cource, in the above-mentioned case, the heat medium is water.

The operation of the above-mentioned system will now be described. For convenience's sake, the case where the heat medium in the tank 5 is water is described.

(1) Case Where Warm Water and Cold Water Are Simultaneously Stored in Tank 5

The valves 12, 23, 24, 31 and 32 are closed and the valves 13 and 26 are opened, and the four-way valve 2 is changed over to the position A indicated by a solid line in the drawings, where the port 2*a* communicates with the port 2*d* and the port 2*b* communicates with the port 2*c*, so that high-temperature high-pressure cooling medium extruded from the cooling medium compressor 1 flows into the heat exchanger 6.

The high-temperature high-pressure vaporized cooling medium extruded from the cooling medium compressor 1 discharges heat at the heat exchanger 6 because the heat exchanger 6 acts as a condenser, and by this discharged heat, water in the upper portion of the tank 5 is heated and converted to warm water and the cooling medium per se is changed to a medium-temperature high-pressure condensed cooling medium. Since the valve 13 is opened, the cooling medium passes through the expanding means 10 and is changed to a low-temperature low-pressure cooling medium by adiabatic expansion. The cooling medium is then introduced into the heat exchanger 8. In this case, the heat exchanger 8 acts as an evaporator, and the cooling medium is evaporated to absorb heat from water in the lower portion of the tank and cool this water. The cooling medium per se is changed to a low-temperature low-pressure evaporated cooling medium and is returned to the cooling medium compressor 1 through the valve 26, four-way valve 2 and accumulator 3, whereby the cooling medium is changed to a high-pressure high-temperature evaporated cooling medium again.

Accordingly, in this cycle, there is attained a heat pump operation in which water in the lower portion of the tank 5 is used as a low-temperature heat source and water in the upper portion of the tank 5 is used as a high-temperature heat source, and hence, warm water is stored in the upper portion of the tank 5 and cold water is stored in the lower portion. Since there is a difference of the specific gravity between warm water and cold water, they are not mingled with each other at all.

(2) Case Where Warm Water Is Stored in Tank 5

In this case, three methods can be adopted for storing water.

According to a first method, both the heat exchangers 6 and 8 are used as the condensers. In this method, the valves 13, 23, 24 and 26 are closed and the valves 12, 31 and 32 are opened.

The high-temperature high-pressure evaporated cooling medium flows into the heat exchangers 6 and 8 in sequence from the cooling medium compressor 1 and is condensed to discharge heat. By this heat, water in the upper and lower portions in the tank 5 is heated to prepare warm water, while the cooling medium per se is changed to a medium-temperature or low-temperature condensed cooling medium. This cooling medium is changed to low-temperature low-pressure cooling medium by the expanding means 9, and this cooling medium absorbs heat through the exterior heat changer 4 and is changed to a low-temperature low-pressure vaporized cooling medium and returned to the cooling medium compresor 1 where the cooling medium is changed to a high-temperature high-pressure vaporized cooling medium.

Accordingly, in this cycle, water in both the upper and lower portions of the tank 5 can be heated, and hence, a heated heat medium can be stored entirely in the tank 5. Incidentally, warm water heated by the lower heat exchanger 8 makes the temperature of water in the tank substantially uniform by convection, and water is futher heated in the upper portion of the tank by the upper heat exchanger 6. Accordingly, high-temperature water and warm water of a lower temperature can be easily obtained in the upper and lower portions, respectively. In the case where at least 3 heat exchangers are arranged in the tank, water is separated into a corresponding number of layers where the temperature is gradually elevated to the upper portion from the lower portion, and these layers can be easily obtained.

According to another method, only the heat exchanger 6 is used but the heat exchanger 8 is not operated. In this method, valves 13, 23 and 26 are closed, and the valves 12, 24, 31 and 32 are opened. The heat exchanger 6 acts in the same manner as described above to store warm water in the upper portion of the tank 5. The cooling medium from the heat exchanger 6 is returned to the cooling medium compressor 1 through the valves 12, 24, 31 and 32. Accordingly, the heat exchanger 8 is not operated and water in the tank 5 is not heated by the heat exchanger 8 at all. Therefore, warm water is only stored in the upper portion in the tank 5. In this method, heating of a small amount of water in the upper portion is sufficient, and hence, the method is suitable for rapid heating.

According to still another method, only the heat exchanger 8 is used as the condenser but the heat exchanger 6 is not operated. In this method, the valves 12, 13, 24 and 26 are closed and the valves 23, 31 and 32 are opened. The cooling medium extruded from the cooling medium compressor 1 is directly introduced into the heat exchanger 8 through the by-passing passage 21 and heat is discharged in the heat exchanger 8. The heat exchanger 6 is not operated and entire water in the tank 5 is uniformly heated only by the heat exchanger 8 by utilizing convention.

(3) Case Where Cold Water Is Stored in Tank 5

As in case of storing warm water, there are three storing methods.

According to a first method, both the heat exchangers 6 and 8 are used as evaporators. In this method, the valves 13, 23, 24 and 26 are closed and the valves 12, 31 and 32 are opened. The four-way valve 2 is changed over to the position B indicated by a dotted line in the drawings where the port 2*a* communicates with the port 2*c* and there port 2*b* communicates with the port 2*d*, whereby the high-temperature high-pressure vaporized cooling medium from the cooling medium compressor 1 flows toward the exterior heat exchanger 4.

The high-temperature high-pressure vaporized cooling medium from the cooling medium compressor 1 discharges heat through the exterior heat exchanger 4 and the cooling medium is changed to a low-temperature low-pressure cooling medium by adiabatic expansion at the expanding means 9. This low-temperature low-pressure condensed cooling medium flows through the heat exchanger 8, the opened valve 12 and the heat exchanger 6 in sequence while the cooling medium is evaporated and absorbs heat to cool water in the upper and lower portions in the tank 5. The cooling medium per se is changed to a low-temperature low-pressure vaporized cooling medium, and this cooling medium is returned to the cooling medium compressor 1 and changed to a high-temperature high-pressure vaporized cooling medium.

Accordingly, in this cycle, water in the upper and lower portions of the tank 5 can be cooled, and hence, cold water can be stored in the entire cooling tank 5.

Especially when water is cooled by the heat exchanger 6, entire water in the tank is cooled to a substantially uniform temperature by convection, and since this cooled water is further cooled by the lower heat exchanger 8, there are formed two cold water layers differing in the temperature in the tank 5 and the temperature of the lower layer is lower.

According to another method, only the heat exchanger 8 is used as the evaporator and the heat exchanger 6 is not operated. In this method, the valves 12, 13, 24 and 26 are closed and the valves 23, 31 and 32 are opened. Cold water is stored in the lower portion of the tank 5 through the heat exchanger 8.

More specifically, the cooling medium fed from the cooling medium compressor 1 is condensed in the exterior heat exchanger 4 acting as the condenser to discharge heat, and adiabatic expansion is caused in the cooling medium by the expanding means 9 and the cooling medium flows in the heat exchanger 8 and is evaporated therein to cool water in the lower portion. Since the valve 23 is opened, the cooling medium passes through the by-passing passage 21 and is returned to the cooling medium compressor 1 without operation of the upper heat exchanger 16.

Accordingly, only water in the lower portion in the tank 5 is cooled to a low temperature because of the difference of the specific gravity between water in the upper portion and water in the lower portion.

Similarly, in the case where the operation of the heat exchanger 8 is stopped and only the heat exchanger 6 is operated as the evaporator, entire water is uniformly cooled in the tank by utilizing convention, as is obvious to persons with ordinary skill in the art.

The operation of cooling or heating air in a room or controlling the temperature in the room by heat exchange with the heat medium in the tank 5 in which the temperature is controlled in the above-mentioned manners will now be described. The principle of this operation is to introduce the heat medium in the tank 5, which is temperature-controlled by the above-mentioned heat pump system, into the heat exchanger 41 for an air conditioner and heat-exchanging the heat medium with air in the room to control the temperature in the room according to the controlled temperature of the heat medium. The larger the number of heat exchangers in the tank 5, larger the number of layers of the heat medium differing in the temperature, and therefore, the heating medium differing in the temperature can be introduced into the heat exchanger 41 and the precision of the temperature control for cooling or heating can be apparently improved.

More specifically, for example, if warm water is stored in the upper portion or all of the tank 5, the heat medium passages 44 and 45 are connected to each other by the electromagnetic valves 43, and this warm water is introduced into the heat exchanger 42 through the suction port 45*a* by the circulating pump 42 and is returned to the lower portion in the tank 5 through the three-way electromagnetic valve 47 and extrusion port 52*a*, whereby heating can be accomplished stably by the heat exchanger 41 without mingling with high temperature warm water in the upper portion. In the case where both the heat exchangers 6 and 8 are operated as the condensers, two kinds of warm water differing in the temperature are obtained in the upper and lower portions in the tank 5. Accordingly, if the lower layer of warm water having a lower temperature is introduced into the heat exchanger 41, low temperature heating can be performed.

In the case where cold water is stored in the lower portion or all of the tank 5, if the heat medium passage 46 is selected by the three-way electromagnetic valve 43 to introduce cold water in the lower portion of the tank 5 into the heat exchanger 41 through the suction port 46*a* and cold water is returned to the upper portion in the tank 5 through the three-way electromagnetic valve 47 and extrusion port 51*a*, cooling can be carried out stably through the heat exchanger 41 without mingling with low-temperature cold water in the upper portion. If both the heat exchangers 6 and 8 are operated as the evaporators, the temperature of cold water in the lower portion is lower than the temperature of cold water in the upper portion, and the cooling temperature can be changed according to the kind of cold water to be introduced into the heat exchanger 41.

Furthermore, if hot water is stored in the upper portion in the tank 5 and cold water is stored in the lower portion in the tank 5, cold water or hot water can be selectively introduced into the heat exchanger 22 according to the state of the passage selection by the three-way electromagnetic valves 43 and 47. Accordingly, heating or cooling can be selectively performed in the heat exchanger 41.

If a plurality of layers of the heat medium differing in the temperature are formed in the tank 5 by the above-mentioned heat pump system, when the heat exchanger arranged in the heat medium of an optional temperature layer is operated, hot water or cold water of an optional temperature can be supplied to the outside by the water supply means.

More specifically, if the passage 65 is selected by the three-way electromagnetic valve 64, water is introduced into the upper heat exchanger 61 from the water supply passage 63 through the water supply passage 65, and water heat-exchanged with the upper heat medium is supplied to the outside through the water supply pipe 68. If the three-way electromagnetic valve 64 selects the heat exchanger 62, water is introduced into the heat exchanger 62 through the water supply passage 66 and heat-exchanged with the heat medium in the lower portion, and heat-exchanged water is supplied to the outside through the water supply pipe 69. The temperature of water to be supplied is based on the controlled temperature of the heat medium in the tank 5. For example, if the heat medium in the tank is maintained at a higher temperature in the upper portion and at a lower temperature in the lower portion, water supplied from the water supply pipe 68 is high-temperature water and water supplied from the water supply pipe 69 is cold water. The system may be arranged so that kinds of water differing in the temperature can be simultaneously supplied by operating all the heat exchangers 61 and 62.

The valve 72 is opened when water is supplied in the tank 5 in the case where the heat medium in the tank 5 is water.

In the foregoing embodiment, any particular member is not disposed in the tank 5. In the present invention, a heat-insulating intermodiate plate 75 having communicating holes for circulation may be disposed in the central portion of the tank 5. If this structure is adopted, when warm water is stored in the upper portion and cold water is stored in the lower portion, the heat-insulating characteristic is especially enhanced.

As is apparent from the foregoing illustration, according to the present invention, there can be provided a heat pump system in which not only a cold liquid or a warm liquid but also kinds of a warm or cold liquid differing in the temperature can be stored or a warm liquid and a cold liquid can be simultaneously stored. Therefore, for example, warm water and cold water can be simultaneously obtained at heating or cooling, and the operation adaptability of the heat pump system can be enhanced over the operation adaptability of the conventional systems.

What is claimed is:

1. A heat medium temperature controlling heat pump system which comprises a tank for storing a heat medium therein, a plurality of first heat exchange means arranged in sequence from the upper portion to the lower portion in the tank, second heat exchange means arranged outside said tank, a cooling medium circulating passage for connecting a plurality of said first heat exchange means to said second heat exchange means in series, means for forcibly circulating a cooling medium in said cooling medium circulating passage, means for reversing the flowing direction of the cooling medium in said cooling medium circulating passage, cooling medium expanding means connected in parallel to the portion of said cooling medium circulating passage between two adjacent upper and lower first heat exchange means, second cooling medium expanding means arranged in series in the portion of said cooling medium circulating passage between the lowermost first heat exchange means and the second heat exchange means, a first by-passing passage by-passing said second heat exchange means so that the cooling medium circulating passage in short-circuited, first valve means for selectively introducing the cooling medium into one of said first cooling medium expanding means and the portion of said cooling medium circulating passage parallel to said first cooling medium expanding means, and second valve means for selectively introducing the cooling medium into one of the first by-passing passage and said second heat exchange means.

2. A heat pump system as set forth in claim 1, wherein the first and second heat exchange means are condensing means and/or evaporating means to be selected.

3. A heat pump system as set forth in claim 1, wherein the tank is a tank for storing water as the heat medium therein.

4. A heat pump system as set forth in claim 1, wherein the means for reversing the flowing direction of the cooling medium is a four-way valve in which the first position where a cooling medium extrusion port of the cooling medium circulating passage is fluidly connected to one connecting port of the topmost first heat exchange means and a cooling medium suction port of the cooling medium circulating passage is fluidly connected to one connecting port of the second heat exchange means and the second position where said extrusion port is fluidly connected to said one connecting port of the heat exchange means and said suction port is fluidly connected to said one connecting port of the topmost first heat exchange means are selectively changed over to each other.

5. A heat pump system as set forth in claim 1, wherein said first valve means includes a pair of opening and closing valves interposed in cooling medium passage including said first cooling medium expanding means and the portion of said cooling medium circulating passage parallel to said first cooling medium expanding means, respectively.

6. A heat pump system as set forth in claim 1, wherein said second valve means includes opening and closing valves interposed in cooling medium passages connected to said first by-passing passage and said second heat exchange means, respectively.

7. A heat pump system as set forth in claim 1, wherein the cooling medium circulating passage includes a second by-passing passage by-passing the respective first heat exchange means and the first cooling medium expanding means adjacent thereto.

8. A heat pump system as set forth in claim 1, wherein the cooling medium circulating passage has a third by-passing passage by-passing the lowermost interior heat exchange means.

9. A heat pump type air-conditioning apparatus, which comprises a tank for storing a heat medium therein, a plurality of first heat exchange means arranged in sequence from the upper portion to the lower portion in the tank, second heat exchange means arranged outside said tank, a cooling medium circulating passage for connecting a plurality of said first heat exchange means to said second heat exchange means in series, means for forcibly circulating a cooling medium in said cooling medium circulating passage, means for reversing the flowing direction of the cooling medium in said cooling medium circulating passage, cooling medium expanding means connected in parallel to the portion of said cooling medium circulating passage between two adjacent upper and lower first heat exchange means, second cooling medium expanding means arranged in series in the portion of said cooling medium circulating passage between the lowermost first heat exchange means and the second heat exchange means, a first by-passing passage by-passing said the second heat exchange means so that the cooling medium circulating passage is short-circuited, first valve means for selectively introducing the cooling medium into one of said first cooling medium expanding means and the portion of the cooling medium circulating passage parallel to said first cooling medium expanding means, second valve means for selectively introducing the cooling medium into one of said first by-passing passage and said second heat exchange means, heat exchange means for air conditioning, and heat medium circulating means for circulating a heat medium between said heat exchange means for air conditioning and said tank.

10. A heat pump type air-conditioning apparatus as set forth in claim 9, wherein said heat exchange means for air conditioning is heat exchange means for cooling and heating air in a room.

11. A heat pump type air-conditioning apparatus as set forth in claim 1, wherein said heat medium circulating means includes selecting means for selectively circulating the heat medium in said tank at a height corresponding to said first heat exchange means into said heat exchange means for air conditioning.

12. A heat pump type water-supplying apparatus, which comprises a tank for storing a heat medium therein, a plurality of first heat means arranged in sequence from the upper portion to the lower portion in the tank, second heat exchange means arranged outside said tank, a cooling medium circulating passage for connecting a plurality of said first heat exchange means to said second heat exchange means in series, means for forcibly circulating a cooling medium in said cooling medium circulating passage, means for reversing the flowing direction of the cooling medium in said cooling medium circulating passage, cooling medium expanding means connected in parallel to the portion of said cooling medium circulating passage between two adjacent upper and lower first heat exchange means, second cooling medium expanding means arranged in series in the portion of said cooling medium circulating passage between the lowermost first heat exchange means and the second heat exchange means, a first by-passing passage by-passing said the second heat exchange means so that the cooling medium circulating passage is short-circuited, first valve means for selectively introducing the cooling medium into one of said first cooling medium expanding means and the portion of the cooling medium circulating passage parallel to said first cooling medium expanding means, second valve means for selectively introducing the cooling medium into one of said first by-passing passage and said second heat exchange means, at least one third heat exchange means arranged in said tank, and water supply means for taking out water and/or hot water heat-exchanged in said third heat exchange means from said tank and applying it to intended use.

13. A heat pump type water-supplying apparatus as set forth in claim 12, wherein said third heat exchange means is located within the heat medium in said tank at a height corresponding to said first heat exchange means.

14. A heat pump type water-supplying apparatus as set forth in claim 13, wherein said water supply means includes selecting means for supplying water selectively to one of said third heat exchange means.

* * * * *